United States Patent [19]

Bares et al.

[11] Patent Number: 4,974,024

[45] Date of Patent: Nov. 27, 1990

[54] PREDICTIVE TONER DISPENSER CONTROLLER

[75] Inventors: Jan Bares, Webster; Gedeminas J. Reinis; Neil A. Frankel, both of Rochester, all of N.Y.

[73] Assignee: Xerox Corporation, Stamford, Conn.

[21] Appl. No.: 375,307

[22] Filed: Jul. 3, 1989

[51] Int. Cl.[5] ..... G03G 21/00

[52] U.S. Cl. ..... 355/246; 118/688; 355/208

[58] Field of Search ..... 355/246, 208; 118/688, 118/689, 246, 208, 245, 204

[56] References Cited

U.S. PATENT DOCUMENTS

| | | | |
|---|---|---|---|
| 3,348,522 | 10/1967 | Donohue | 118/7 |
| 3,754,821 | 8/1973 | Whited | 355/4 |
| 3,801,196 | 4/1974 | Knapp et al. | 355/3 |
| 3,873,197 | 3/1975 | Whited | 355/3 DD |
| 3,960,444 | 6/1976 | Gundlach et al. | 355/3 DD |
| 4,273,843 | 6/1981 | Fujita et al. | 430/30 |
| 4,348,099 | 9/1982 | Fantozzi | 355/71 X |
| 4,348,100 | 9/1982 | Snelling | 355/246 |
| 4,352,553 | 10/1982 | Hirahara | 355/208 X |
| 4,522,481 | 6/1985 | Imai et al. | 355/3 DD |
| 4,786,924 | 11/1988 | Folkins | 355/246 X |
| 4,801,980 | 1/1989 | Arai et al. | 355/14 D |
| 4,833,506 | 5/1989 | Kuru et al. | 355/246 X |
| 4,847,659 | 7/1989 | Resch, III | 355/208 X |

*Primary Examiner*—A. T. Grimley
*Assistant Examiner*—Thu A. Dang
*Attorney, Agent, or Firm*—H. Fleischer; J. E. Beck; R. Zibelli

[57] ABSTRACT

An apparatus which controls the dispensing of marking particles into a developer unit used in an electrophotograhic printing machine adapted to reproduce a copy of an original document. The quantity of marking particles required to reproduce the copy of the original document is predicted and the dispensing of marking particles controlled in response thereto.

5 Claims, 3 Drawing Sheets

PREDICTIVE TONER DISPENSER CONTROLLER

This invention relates generally to an electrophotographic printing machine, and more particularly concerns an apparatus for controlling dispensing of marking particles into a developer unit.

In a typical electrophotographic printing process, a photoconductive member is sensitized by charging its' surface to a substantially uniform potential. The charged portion of the photoconductive member is exposed to a light image of an original document being reproduced. Exposure of the charged photoconductive member selectively dissipates the charge in the irradiated areas to record an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

It is generally well known that the density or concentration of toner particles has to be maintained within an appropriate range in order to continuously obtain copies having a desired density. However, toner particles are being continuously depleted from the developer material as copies are being formed. Many types of systems have been developed for detecting the concentration of toner particles in the developer material. For example, a test patch recorded on the photoconductive surface is developed to form a solid area of developer material. Generally, the density of the developer material developed on the test patch is monitored by an infrared densitometer. The density of the developed test patch, as measured by the infrared densitometer, is compared to a reference level. The resulting error signal is detected by a control system that regulates the dispensing of toner particles from a storage container. However, a system used to replenish toner particles into the developer material is fairly inaccurate, since the repeatability of the toner particle flow under identical conditions is poor. As a result, the amount of toner particles actually dispensed fluctuates around the average value set by the control system. Accordingly, accurate toner particle concentration will not reduce the control bandwidth. One of the major causes of the wide control bandwidth is the delay built into the control loop. The control loop detects low toner particle concentration after this condition has been reached and does not anticipate the requirement to furnish additional toner particles before the low toner particle concentration condition is reached. In addition, added toner particles have to be mixed with the developer material and charged to the appropriate level. Mixing and charging of the toner particles requires additional time. In order to narrow the bandwidth, it is necessary to reduce the time delay. Thus, it is desirable to use an open loop predicative system in conjunction with a closed loop system to reduce the response time. The following disclosures appear to be relevant:

U.S. Pat. No. 3,348,522, patentee: Donohue, issued: Oct. 24, 1967.

U.S. Pat. No. 3,754,821, patentee: Whited, issued: Aug. 28, 1973.

U.S. Pat. No. 3,801,196, patentee: Knapp et al., issued: Apr. 2, 1974.

U.S. Pat. No. 3,873,197, patentee: Whited, issued: Mar. 25, 1975.

U.S. Pat. No. 3,960,444, patentee: Gunddlach et al., issued: June 1, 1976.

U.S. Pat. No. 4,273,843, patentee: Fujita et al., issued: June 16, 1981.

U.S. Pat. No. 4,522,481, patentee: Imai et al., issued: June 11, 1985.

U.S. Pat. No. 4,801,980, patentee: Arai et al., issued: Jan. 31, 1989.

The relevant portions of the foregoing patents may be summarized as follows:

U.S. Pat. No. 3,348,522 describes a toner dispensing control system in which a stripe is developed on a photoconductive drum. The developed stripe and an undeveloped portion of the drum are illuminated. The light rays reflected therefrom are received by phototransistors which form two legs of a bridge circuit. The output from the bridge circuit controls dispensing of toner.

U.S. Pat. No. 3,754,821, U.S. Pat. No. 3,873,197 and U.S. Pat. No. 3,960,444 disclose a transparent electrode mounted on a photoconductive drum. The electrode is electrically biased to attract toner particles thereto as the electrode passes through the development station. A light source transmits light rays through the electrode having the toner particles attracted thereto. The light rays transmitted therethrough are received by a phototransistor which measures the intensity thereof. The output from the phototransistor is compared to a reference signal and the resultant error signal controls dispensing of toner particles.

U.S. Pat. No. 3,801,196 describes a glass slug having an electrically conductive surface. The slug is mounted on a photoconductive drum and electrically biased to attract toner particles thereto during development. A light source illuminates the toner particles adhering to the glass slug. The intensity of the reflected light rays is measured by a photosensor. The output from the photosensor is compared to a reference and an error signal generated which controls dispensing of toner particles.

U.S. Pat. No. 4,273,843 discloses a transparent plate mounted in the bottom of a developer housing. A light source illuminates developer material through the transparent plate and a light receiving element detects the intensity of the light rays reflected from the developer material. Toner dispensing is controlled as a function of the intensity of the light rays detected by the light receiving element.

U.S. Pat. No. 4,522,481 describes an electrostatic latent image of a reference pattern recorded on a photoconductive drum. The reference pattern latent image is developed. A sensor senses the degree of toner deposition on the latent image and sends a signal to a control unit. The control unit controls the rotation of a toner roller for dispensing toner into a developer unit. A fatigue standard setting unit adjusts the developer roll bias to compensate for the degree of photoconductor fatigue.

U.S. Pat. No. 4,801,980 discloses a sensor which passes over a developed image patch on a photosensitive drum. Reflectance data is taken in the non-image region as well as the patch region to determine the density of the toner. When the density is lower than a reference, additional toner is furnished from a toner hopper.

In accordance with one aspect of the present invention, there is provided an apparatus for controlling the dispensing of marking particles into a developer unit used in an electrophotographic printing machine adapted to reproduce a copy of an original document. The apparatus includes means for storing a supply of marking particles. Means are provided for discharging marking particles from the storing means into the developer unit. Means predict the quantity of marking particles required to reproduce the copy of the original document and control the discharging means in response thereto.

Pursuant to another aspect of the features of the present invention, there is provided an electrophotographic printing machine for reproducing a copy of an original document in which a latent image of the original document is recorded on a photoconductive member with the latent image being developed with marking particles at a developer unit. The improvement includes means for storing a supply of marking particles. Means are provided for discharging marking particles from the storing means into the developer unit. Means predict the quantity of marking particles required to reproduce the copy of the original document and control the discharging means in response thereto.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
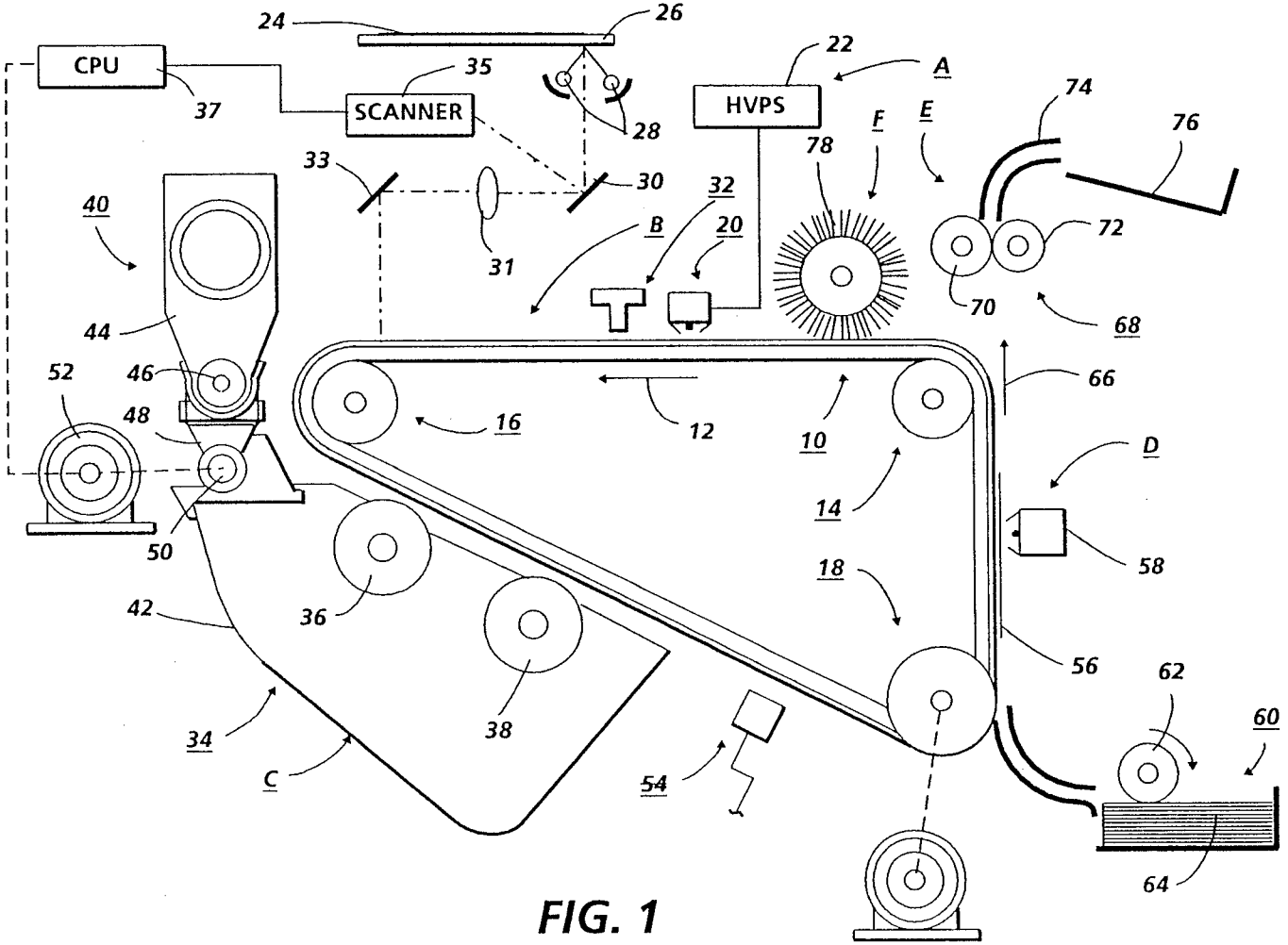
FIG. 1 is a schematic elevational view depicting an illustrative electrophotographic printing machine incorporating the features of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the present invention may be employed in a wide variety of printing machines and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on a anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, and drive roller 18. Stripping roller 14 is mounted rotatably so as to rotate with belt 10. Tensioning roller 16 is resiliently urged against belt 10 to maintain belt 10 under the desired tension. Drive roller 18 is rotated by a motor coupled thereto by suitable means such as a belt drive. As roller 18 rotates, it advances belt 10 in the direction of arrow 12.

Initially, a portion of the photoconductive surface passes through charging station A. At charging station A, a corona generating device, indicated generally by the reference numeral 20, charges the photoconductive belt 10 to a relatively high, substantially uniform potential. Corona generating device 20 includes a generally U-shaped shield and a charging electrode. A high voltage power supply 22 is coupled to corona generating device 20. A change in the output of power supply 22 causes corona generating device 20 to vary the charge applied to the photoconductive belt 10.

Next, the charged portion of the photoconductive surface is advanced through imaging station B. At imaging station B, an original document 24 is positioned face down upon a transparent platen 26. Lamps 28 move across platen 26 to illuminate successive incremental areas of original document 24. The light rays reflected from original document 24 are reflected from mirror 30 through lens 31 onto mirror 33. Mirror 33 reflects the light image of the original document onto the charged portion of photoconductive belt 10. This records an electrostatic latent image on the photoconductive belt which corresponds to the informational areas contained within the original document. The light rays reflected from mirror 30 are also reflected to a scanner 35. By way of example, scanner 35 may be a raster input scanner (RIS) which includes a lens for forming a light image of the original document which is transmitted to a solid state optical-electrical panel, such as charged coupled device matrix or array (CCD array). Mirror 30, scanner 35, and lens 31 move in timed relationship with lamps 28 so as to be in the proper relationship with respect to one anther to from the light image of the original document. The scanner 35 generates an electrical image of the original document. Scanner 35 is coupled to a centralized processing unit (CPU). The CPU counts the number of dark pixels and light pixels to determine the average amount of toner particles required to develop the latent image. In lieu of a CCD array, scanner 35 may use a phototransistor to measure the amount of light reflected from the original document. The scanner may also use a reference phototransistor which measures the light reflected from a corner of the original document. This corner is a blank region and provides a reference level for comparison with the measured amount of light averaged across the document. The CPU processes these signals in a suitable circuit and generates an output signal used to anticipate the amount of toner particles required to form a copy of the original document. This output signal controls the dispensing of toner particles into the developer housing. The anticipatory dispensing system is an open loop system which converts the measure of the original area coverage into the amount of toner required. An open loop system of this type can gradually increase or decrease the toner particle concentration within the developer material. This is due to developability varying according to environmental and operator selections in addition to document average coverage requirements. To prevent this from occurring, a closed loop system may be employed in conjunction with the open loop anticipatory system. This is accomplished by having imaging station B include a test area generator, indicated generally by the reference numeral 32. Test generator 32 comprises a light source and a filter. The light rays are transmitted through the filter onto the charged portion of photoconductive belt 10, in the inter-image region, i.e. between successive electrostatic latent images recorded on photoconductive belt 10. The filter modulates the light rays from the light source to record a test patch on the photoconductive belt. The test patch recorded on photoconductive belt 10 is a square approximately 5 centimeters by 5 centimeters. One skilled in the art will appreciate that a raster output scanner (ROS) may be used in lieu of a light source and filter. The ROS uses a laser whose beam is modulated. The modulated light beam is directed onto the charged region of the photoconductive belt 10, in the inter-image region, to selectively dissipate the charge thereon. The electrostatic latent image and test patch are then developed with toner particles at development station C. In this way, a toner powder image and a developed test patch is formed on photoconductive belt 10. The developed test patch is subsequently examined to determine the quality of the toner image being developed on the photoconductive belt. A densitometer 54 measures the density of the developed test patch and transmits a signal to CPU 37. CPU 37 controls the dispensing of toner particles in response to the signal from the densitometer and from the scanner.

At development station C, a magnetic brush development system, indicated generally by the reference numeral 34, advances a developer material into contact with the electrostatic latent image and test patch recorded on photoconductive belt 10. Preferably, magnetic brush development system 34 includes two magnetic brush developer rollers 36 and 38. These rollers each advance the developer material into contact with the latent image and test areas. Each developer roller forms a brush comprising carrier granules and toner particles. The latent image and test patch attract the toner particles from the carrier granules forming a toner powder image on the latent image and a developed test patch. As toner particles are depleted from the developer material, a toner particle dispenser, indicated generally by the reference numeral 40, furnishes additional toner particles to housing 42 for subsequent use by developer rollers 36 and 38, respectively. Toner dispenser 40 includes a container 44 storing a supply of toner particles therein. A foam roller 46 disposed in sump 48 coupled to container 44 dispenses toner particles into an auger 50. Auger 50 is made from a helical spring mounted in a tube having a plurality of apertures therein. Motor 52 rotates the helical spring to advance the toner particles through the tube so that toner particles are dispensed from the apertures therein. Actuation of motor 52 is controlled by CPU 37.

Densitometer 54, positioned adjacent the photoconductive belt between developer station C and transfer station D, generates electrical signals proportional to the developed test patch. These signals are conveyed to a control system and suitably processed for regulating the processing stations of the printing machine. Preferably, densitometer 54 is an infrared densitometer. The infrared densitometer is energized at 15 volts DC and about 50 milliamps. The surface of the infrared densitometer is about 7 millimeters from the surface of photoconductive belt 10. Densitometer 54 includes a semiconductor light emitting diode having a 940 nanometer peak output wavelength with a 60 nanometer one-half power bandwidth. The power output is approximately 45 milliwatts. A photodiode receives the light rays reflected from the developed half tone test patch and converts the measured light ray input to an electrical output signal. The infrared densitometer is also used to periodically measure the light rays reflected from the bare photoconductive surface, i.e. without developed toner particles, to provide a reference level for calculation of the signal ratio. After development, the toner powder image is advanced to transfer station D.

At transfer station D, a copy sheet 56 is moved into contact with the toner powder image. The copy sheet is advanced to transfer station D by a sheet feeding apparatus 60. Preferably, sheet feeding apparatus 60 includes a feed roll 62 contacting the uppermost sheet of a stack 64 of sheets. Feed rolls 62 rotate so as to advance the uppermost sheet from stack 64 into chute 66. Chute 66 guides the advancing sheet from stack 64 into contact with the photoconductive belt in a timed sequence so that the toner powder image developed thereon contacts the advancing sheet at transfer station D. At transfer station D, a corona generating device 58 sprays ions onto the backside of sheet 56. This attracts the toner powder image from photoconductive belt 10 to copy sheet 56. After transfer, the copy sheet is separated from belt 10 and a conveyor advances the copy sheet, in the direction of arrow 66, to fusing station E.

Fusing station E includes a fuser assembly, indicated generally by the reference numeral 68 which permanently affixes the transferred toner powder image to the copy sheet. Preferably, fuser assembly 68 includes a heated fuser roller 70 and a pressure roller 72 with the powder image on the copy sheet contacting fuser roller 70. In this manner, the toner powder image is permanently affixed to sheet 56. After fusing, chute 74, guides the advancing sheet 56 to catch tray 76 for subsequent removal from the printing machine by the operator.

After the copy sheet is separated from photoconductive belt 10, the residual toner particles and the toner particles adhering to the test patch are cleaned from photoconductive belt 10. These particles are removed from photoconductive belt 10 at cleaning station F. Cleaning station F includes a rotatably mounted fibrous brush 78 in contact with photoconductive belt 10. The particles are cleaned from photoconductive belt 10 by the rotation of brush 78. Subsequent to cleaning, a discharge lamp (not shown) floods photoconductive belt 10 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
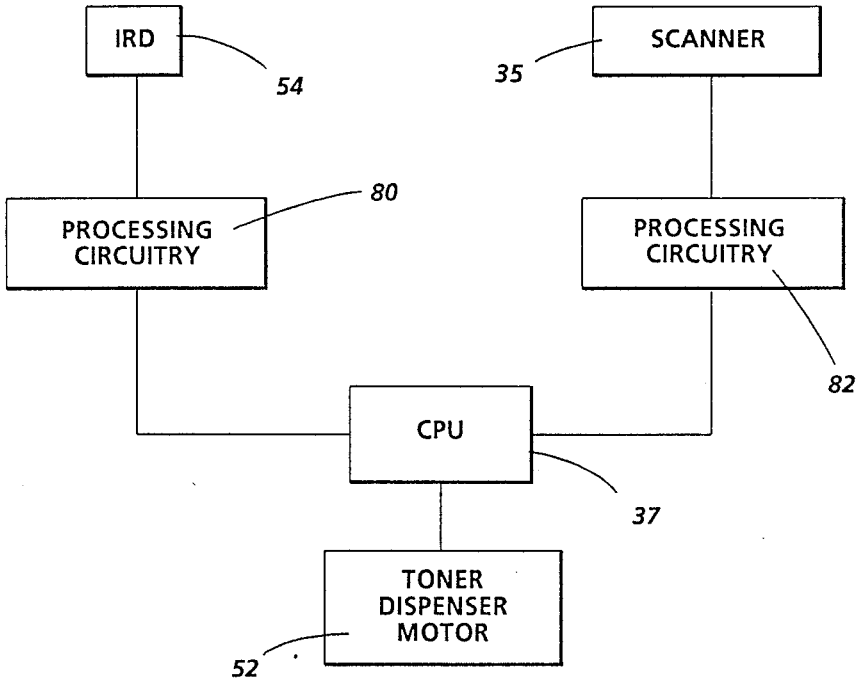
FIG. 2 is a block diagram showing the control system used in the FIG. 1 printing machine.

Referring now to FIG. 2, infrared densitometer 54 detects the density of the developed test patch and produces an electrical output signal indicative thereof. In addition, an electrical output signal is periodically generated by infrared densitometer 54 corresponding to the bare or undeveloped photoconductive surface. These signals are conveyed to CPU 37 through suitable processing circuitry 80. Processing circuitry 80 forms the ratio of the developed test patch signal/bare photoconductive surface signal and generates electrical error signals proportional thereto. The error signal is transmitted to CPU 37 which processes the error signal so that it controls toner dispenser motor 52. Energization of motor 52 causes toner dispenser 40 to discharge toner particles into developer housing 42. This increases the concentration of toner particles in the developer mixture. Scanner 35 measures the average area of the original document that is to be covered with toner particles and develops a reference level indicative of the background level of a blank copy sheet. These signals are converted by processing circuitry 82 into an error signal which is transmitted to CPU 37. CPU 37 develops a control signal in response to the error signal from processing circuitry 82 for regulating the energization of toner dispenser motor 52. The signal from processing circuitry 82 varies for each original document being reproduced in the printing machine whereas the signal from processing circuitry 80 varies slowly as the concentration of toner particles in the developer mixture deviates from the desired level.

Figure 3:
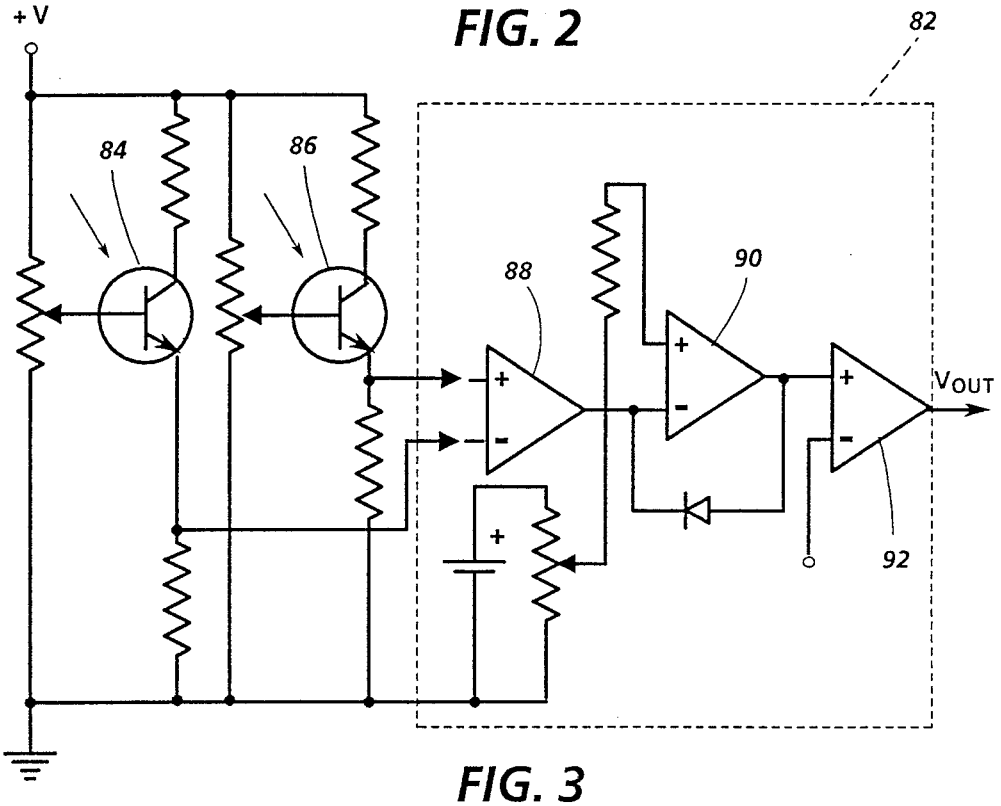
FIG. 3 illustrates a circuit diagram for processing the signals from the scanner.

Referring now to FIG. 3, there is shown suitable processing circuitry 82 associated with a pair of phototransistors 84 and 86. Phototransistor 84 produces a voltage output proportional to the light reflected from a blank or clean original document by detecting the light reflected from the corner region of the original document. Phototransistor 86 produces a voltage output proportional to the total amount of light reflected from the original document. Processing circuitry 82 includes amplifiers 88, 90 and 92. Amplifier 88 subtracts the signals from phototransistors 84 and 86. The output signal from amplifier 88 is a signal proportional to the anticipated toner particle consumption. Amplifier 90 transmits a signal only when the signal received from amplifier 88 is larger than a reference threshold. In this way, amplifier 90 activates the circuit only when the anticipated toner particle consumption exceeds the reference threshold. Amplifier 92 enables the operator to adjust the anticipated toner particle consumption as a function of the operator adjusted increase or decrease in the darkness of the copy of the original document. The reference voltage from the operator adjusted copy darkness control adds or subtracts from the input signal to amplifier 92. This increases or decreases the anticipated toner particle signal based upon the operator darkness selection. The output signal from amplifier 92 is proportional to the anticipated toner particle consumption for the original document being reproduced by the copy. This signal is transmitted to CPU 37.

Phototransistor 84 measures the amount of light reflected from a corner or border of the original document. Border area sampling establishes the reflectivity of the blank original document. This enables a determination of the area coverage of the original document. The area coverage of the original document, as measured by phototransistor 86, is only the area of the original document that is darker than the blank border region detected by phototransistor 84. The change of reflected light as a function of area coverage may be expressed as $$l = (\%\ \text{area coverage})(1 - 10^{-D})$$

where l is the change in the amount of light in % reflected from the original document due to a given area coverage.

$$D = D_C - D_B$$

where $D_C$ is the reflection optical density of the covered original document, and $D_B$ is the reflection optical density of the blank or clean sheet as determined from the document corner.

Since the reference level accounts for the darkness of the blank sheet of paper having the information of the original document thereon, l is zero when the area coverage is zero. l is proportional to the area coverage with the proportionality constant being a function of the reflection density difference, D. Curves for different values of D as a function of area coverage are shown in FIG. 4.

Figure 4:
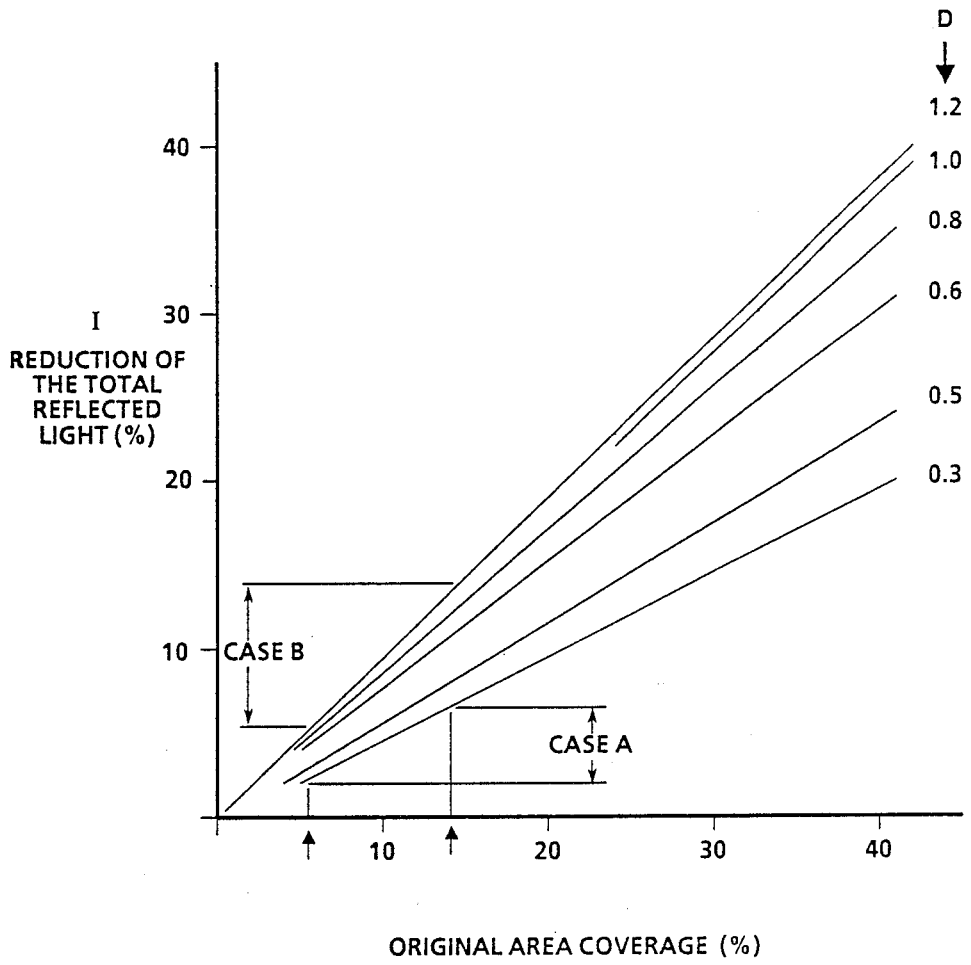
FIG. 4 shows test data expressing the change of reflected light as a function of the area coverage.

Turning now to FIG. 4, case A represents an unlikely demanding case, where the original document has lettering printed on dark paper with the lettering being only 0.3 density units darker than the paper. For example, in case the document area coverage changes from a normal 6% to 15%, the total reflected light is reduced by 4%, i.e. l is reduced by 4%. This change can be readily detected with a phototransistor. A typical case is shown as case B. In case B, there is a high optical density message on a relatively lightly colored paper (D = 1.2). The change in the area coverage of from 6% to 15% results in a light reduction of more than 8%. It is thus clear that by referencing the light detector to the reflection optical density of the original document, changes in light intensity are readily detectable. These changes are an appropriate measure of the anticipated toner particle consumption.

In recapitulation, the control system of the present invention uses an open loop system which anticipates the required quantity of toner particles necessary to reproduce an original document and transmits a signal proportional thereto for regulating the dispensing of toner particles into a developer housing. In addition, a closed loop records a test patch on the photoconductive belt which is developed. The intensity of the developed test patch is detected and compared to a reference. The error signal is also used to control toner particle dispensing. In this way, there is a rapidly changing open loop toner particle anticipatory system and a more slowly varying closed loop toner particle concentration detection system. These systems operate to complement one another so as to optimize copy quality.

It is, therefore, evident that there has been provided, in accordance with the present invention, an apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. An electrophotographic printing machine for reproducing a copy of an original document in which a latent image of the original document is recorded on a photoconductive member with the latent image being developed with marking particles at a developer unit, wherein the improvement includes:

means for storing a supply of marking particles;

means for discharging marking particles from said storing means into the developer unit;

means for scanning the original document and generating an output signal corresponding to the average area of the original document having indicia thereon; and means, responsive to the output signal from said scanning means, for generating a control signal that is transmitted to said discharging means to regulate dispensing of marking particles into the developer unit.

2. A printing machine according to claim 1, wherein said scanning means includes a raster input scanner.

3. A printing machine according to claim 2, further including:

means for recording a test patch;

means for developing the test patch with marking particles; and means, responsive to the density of the developed image on the photoconductive member, for regulating said discharging means.

4. A printing machine according to claim 3, wherein said regulating means includes a densitometer for measuring the average density of the marking particles developed on the test patch and generating a signal corresponding thereto.

5. A printing machine according to claim 4, wherein said generating means receives the signal from said densitometer and, in response thereto, generates another control signal that is transmitted to said discharging means.

* * * * *